US007083582B2

(12) United States Patent
Chen

(10) Patent No.: US 7,083,582 B2
(45) Date of Patent: Aug. 1, 2006

(54) MASSAGING MECHANISM OF MASSAGING MACHINE

(76) Inventor: Ko-Po Chen, No. 36, 12th Road, Ta-Li Industrial District, Ta-Li City, Taichung (TW)

( * ) Notice: Subject to any disclaimer, the term of this patent is extended or adjusted under 35 U.S.C. 154(b) by 356 days.

(21) Appl. No.: 10/694,703

(22) Filed: Oct. 22, 2003

(65) Prior Publication Data

US 2005/0090770 A1 Apr. 28, 2005

(51) Int. Cl.
*A61H 15/00* (2006.01)

(52) U.S. Cl. ..... 601/99; 601/100; 601/102; 601/103; 601/116

(58) Field of Classification Search ..... 601/86, 601/87, 90, 93–95, 97, 98–103, 116, 117, 601/122, 126, 134
See application file for complete search history.

(56) References Cited

U.S. PATENT DOCUMENTS 6,224,563 B1 * 5/2001 Nonoue et al. ..... 601/99
6,511,448 B1 * 1/2003 Furuie et al. ..... 601/98
6,629,939 B1 * 10/2003 Jikiba et al. ..... 601/99

* cited by examiner

*Primary Examiner*—Quang D. Thanh
(74) *Attorney, Agent, or Firm*—W. Wayne Liauh

(57) ABSTRACT

A massaging machine comprises a plurality of massaging rollers, a rubbing mechanism for actuating the massaging rollers to engage in a rubbing action, a pounding mechanism for actuating the massaging rollers to engage in a pounding action, and a horizontal displacement mechanism for causing the massaging rollers to engage in a horizontal displacement on a rubbing shaft of the rubbing mechanism, so as to widen the massaging range of the massaging rollers.

6 Claims, 14 Drawing Sheets

MASSAGING MECHANISM OF MASSAGING MACHINE

FIELD OF THE INVENTION

The present invention relates generally to a massaging machine, and more particularly to a massaging mechanism of the massaging machine.

BACKGROUND OF THE INVENTION

As shown in FIGS. 1–5, the U.S. Pat. Ser. No. 10/618,438 discloses a massaging machine comprising a frame displacement mechanism 1, a rubbing mechanism 2, a pounding mechanism 3, and an adjustment mechanism 4. The frame displacement mechanism 1 comprises a motor 11 and a belted wheel set 12 driven by the motor 11. The belted wheel set 11 actuates a worm and gear set 13 which is mounted on a main displacement shaft 14. The displacement shaft 14 is provided at both ends thereof with a gear 15 engaging a rack 16 of a machine frame. An auxiliary displacement shaft 18 is connected by a connection piece 17. The rubbing mechanism 2 comprises an outer cover 21 which is suspended on the auxiliary shaft 18. A motor 22 is used to drive a belted wheel set 23 which actuates a worm and gear set 24 mounted on a rubbing shaft 25. The rubbing shaft 25 is provided at both ends with a swing arm 26 having two massaging rollers 27. The pounding mechanism 3 comprises a motor 31 for driving a belted wheel set 32 which actuates a pounding shaft 33 penetrating the outer cover 21. The pounding shaft 33 is provided with two eccentric ends on which a mounting seat 34 is fastened for mounting a connection rod 35. The connection rod 35 is used to connect the swing arms 26 of the rubbing mechanism 2. The angular adjustment mechanism 4 comprises a motor 41 mounted on the connection piece 17 of the displacement mechanism 1 for driving a belted wheel set 42 which actuates a worm and gear set 43. The worm and gear set 43 is mounted on an angle shaft 44 which is mounted on the connection piece 17 of the displacement mechanism 1 and is provided with a gear 45 engaging an arcuate rack 46 fastened to the underside of the outer cover 21. As the rubbing mechanism 2 is in action, the belted wheel set 23 is driven by the motor 22 to actuate the worm and gear set 24, thereby resulting in rotation of the rubbing shaft 25. In light of the massaging rollers 27 being mounted slantingly on the rubbing shaft 25, the massaging rollers 27 are capable of rubbing action. As the pounding mechanism 3 is in action, the eccentric ends of the pounding shaft 33 enable the two swing arms 26 to be actuated by the connection rod 35 to swivel up and down, thereby resulting in alternate pounding action by the two massaging rollers 27.

As illustrated in FIGS. 1, 2, and 6, as the displacement mechanism 1 is in operation, the main displacement shaft 14 is actuated to turn, thereby resulting in a linear displacement of the gear 15 on the rack 16.

As illustrated in FIGS. 1, 5, and 7, as the angular adjustment mechanism is in operation, the angle shaft 44 is actuated to turn, thereby resulting in engagement of the gear 45 with the arcuate rack 46. As a result, the two swing arms 26 are tilted so as to enable a user of the machine to choose one of the two massaging rollers 27 to bring about a massaging motion. In light of the massaging rollers 27 being mounted fixedly on the rubbing shaft to carry out a massaging action at a fixed point, the massaging range of the massaging rollers 27 is limited.

SUMMARY OF THE INVENTION

The primary objective of the present invention is to provide a massaging machine with a massaging mechanism free of the shortcoming of the prior art massaging mechanism described above.

In keeping with the principle of the present invention, the foregoing objective of the present invention is attained by a massaging machine comprising a horizontal displacement mechanism by which the massaging rollers are enabled to do both the rubbing action and the pounding action. The massaging rollers are mounted on a rubbing shaft of a rubbing mechanism in conjunction with a rubbing shaft sleeve and a pounding shaft sleeve, which are provided with a slide block. The slide block is inserted into a guide slot of the rubbing shaft or the pounding shaft. The horizontal displacement mechanism comprises a drive member for driving a first connection rod and a second connection rod. The rubbing shaft sleeve and the pounding shaft sleeve are caused by the second connection rod to displace simultaneously, thereby causing the slide blocks of the rubbing shaft sleeve and the pounding shaft sleeve to slide respectively in the guide slots of the rubbing shaft and the pounding shaft. As a result, the two massaging rollers are displaced horizontally to carry out rubbing action and the pounding action at different parts of the body of a user of the massaging machine.

The rubbing shaft sleeve is of an eccentric design. As a result, when the rubbing shaft turns, the rubbing shaft sleeve and the massaging rollers are simultaneously actuated to bring about a rubbing action.

The pounding shaft sleeve is of an eccentric design. As a result, when the pounding shaft turns, the pounding shaft sleeve is actuated to turn to bring about an up-and-down motion of the swing arms, thereby resulting in a pounding action brought about by the massaging rollers.

The features and the advantages of the present invention will be more readily understood upon a thoughtful deliberation of the following detailed description of a preferred embodiment of the present invention with reference to the accompanying drawings.

DETAILED DESCRIPTION OF THE PREFERRED EMBODIMENT

Figure 1:
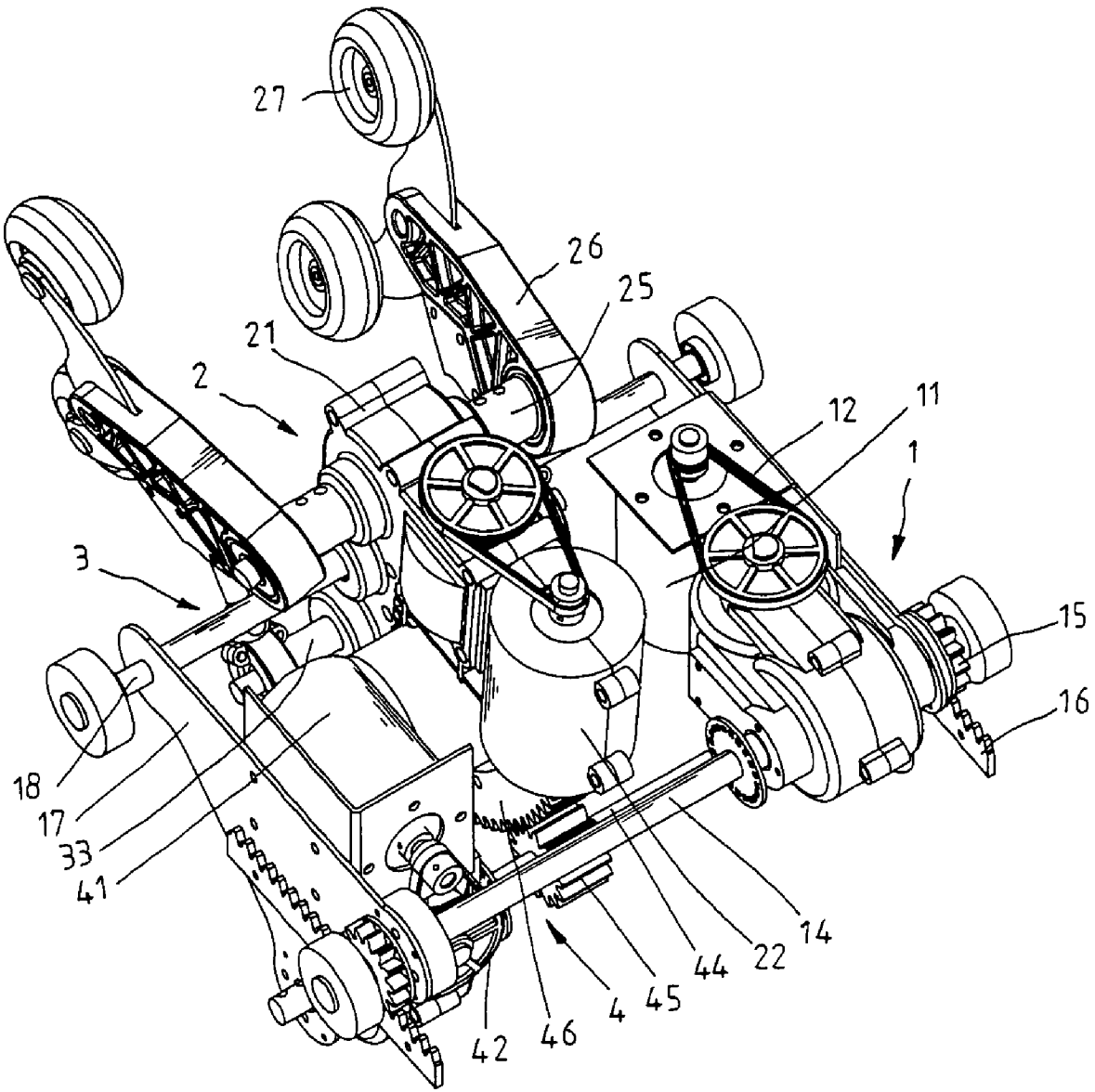
FIG. 1 PRIOR ART
FIG. 1 shows schematic view of a massaging machine of the prior art.
Figure 2:
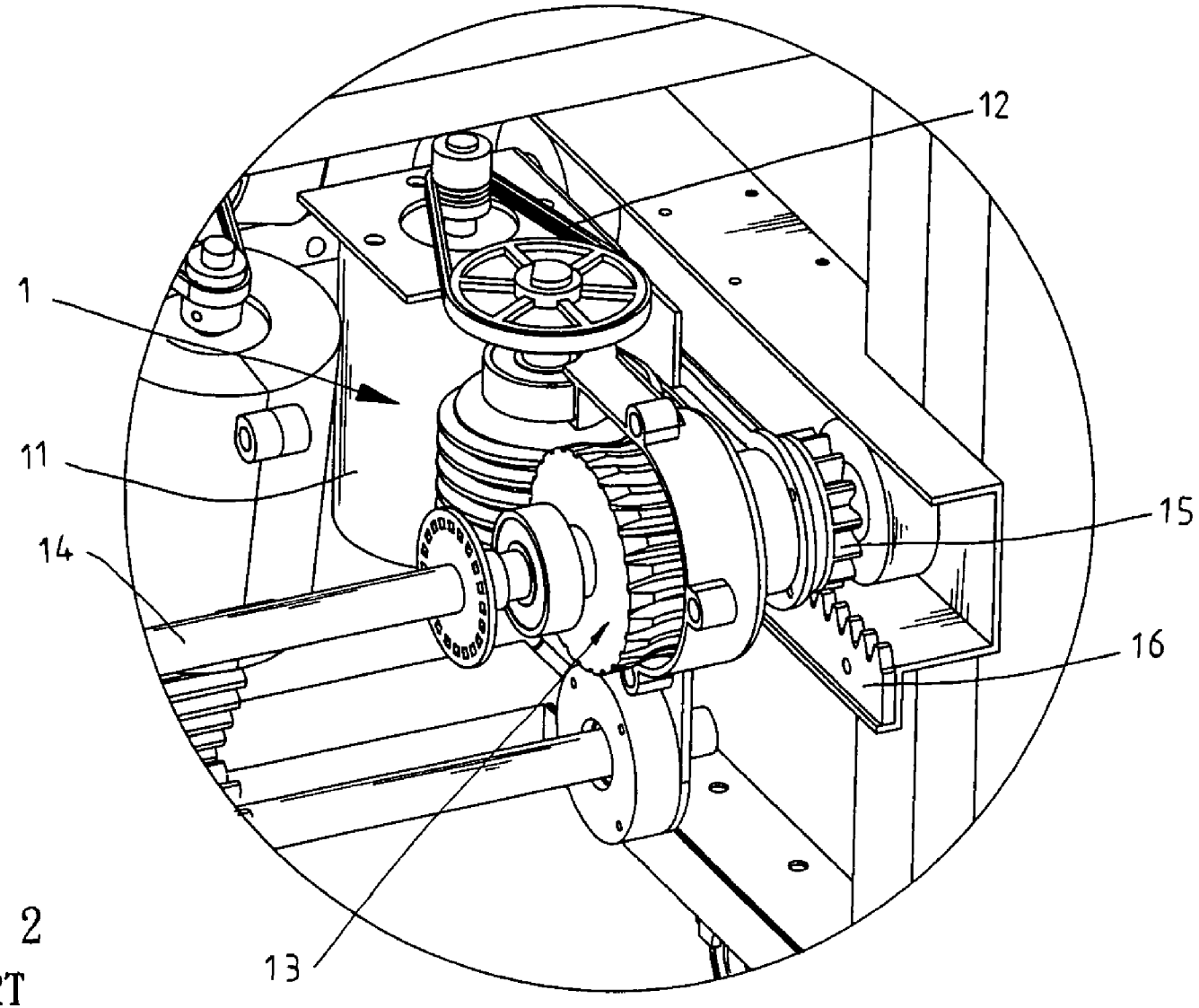
FIG. 2 PRIOR ART
FIG. 2 shows a partial schematic view of a displacement mechanism of the prior art massaging machine.
Figure 3:
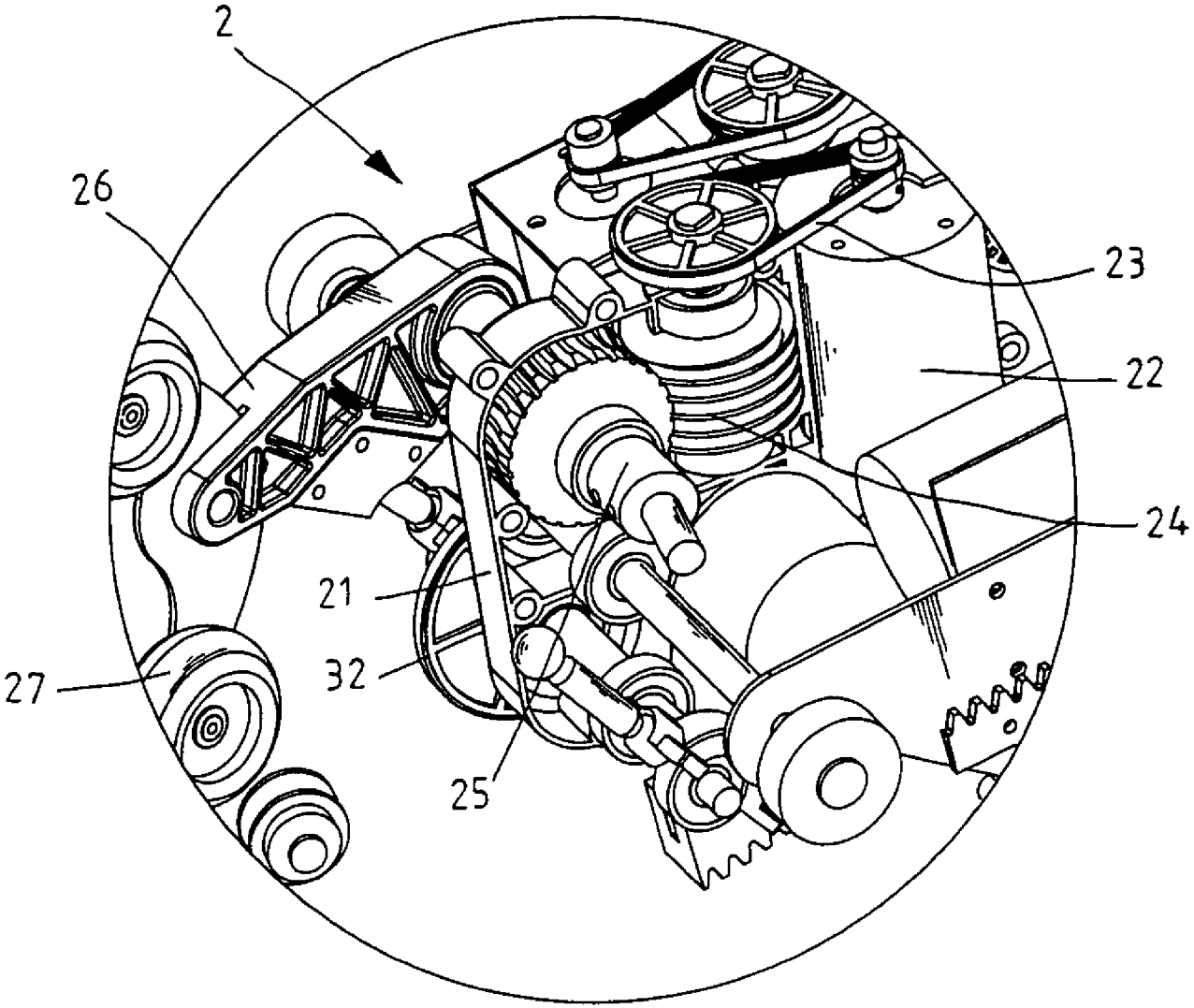
FIG. 3 PRIOR ART
FIG. 3 shows a partial schematic view of a rubbing mechanism of the prior art massaging machine.
Figure 4:
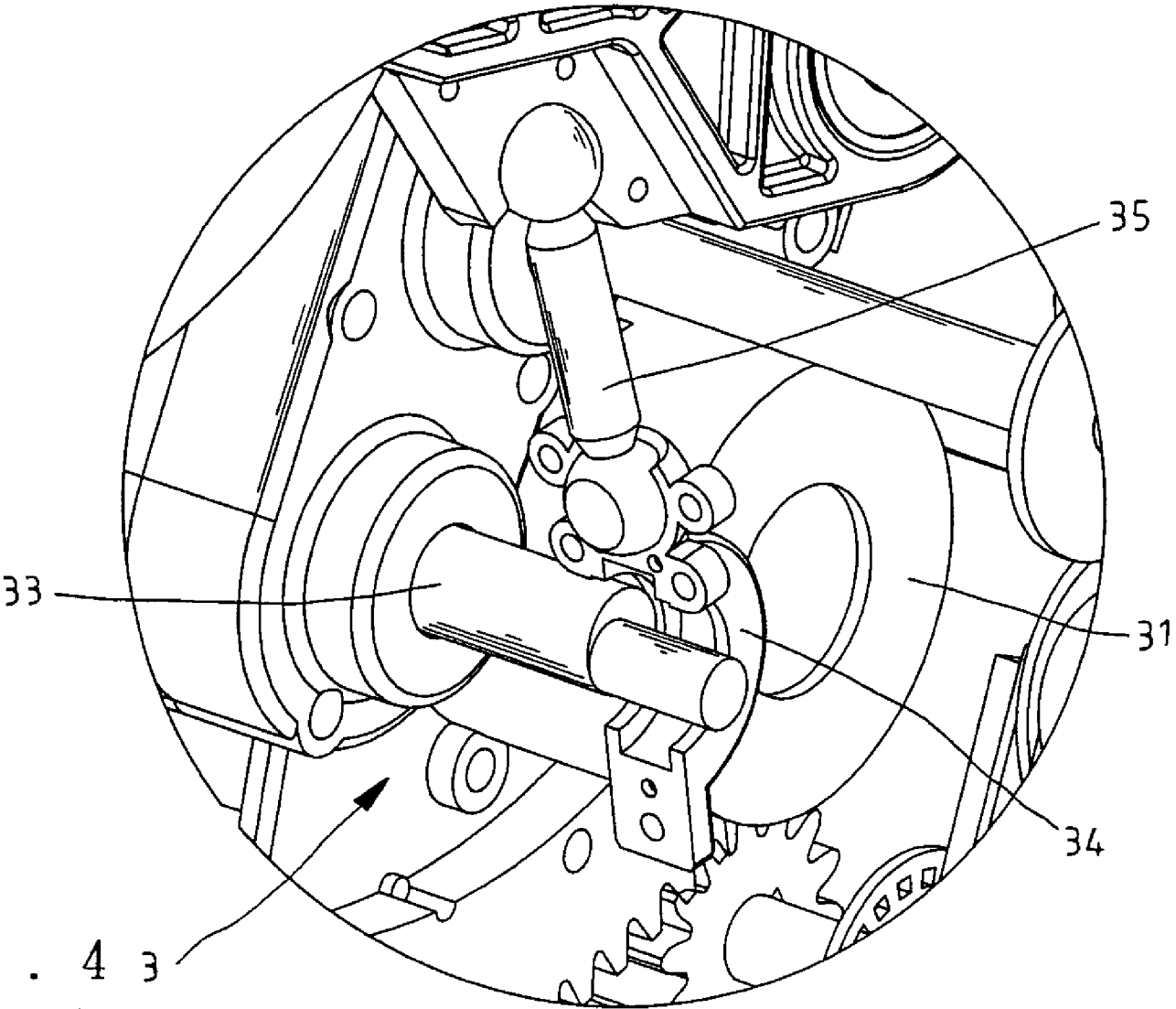
FIG. 4 PRIOR ART
FIG. 4 shows a partial schematic view of the prior art massaging machine.
Figure 5:
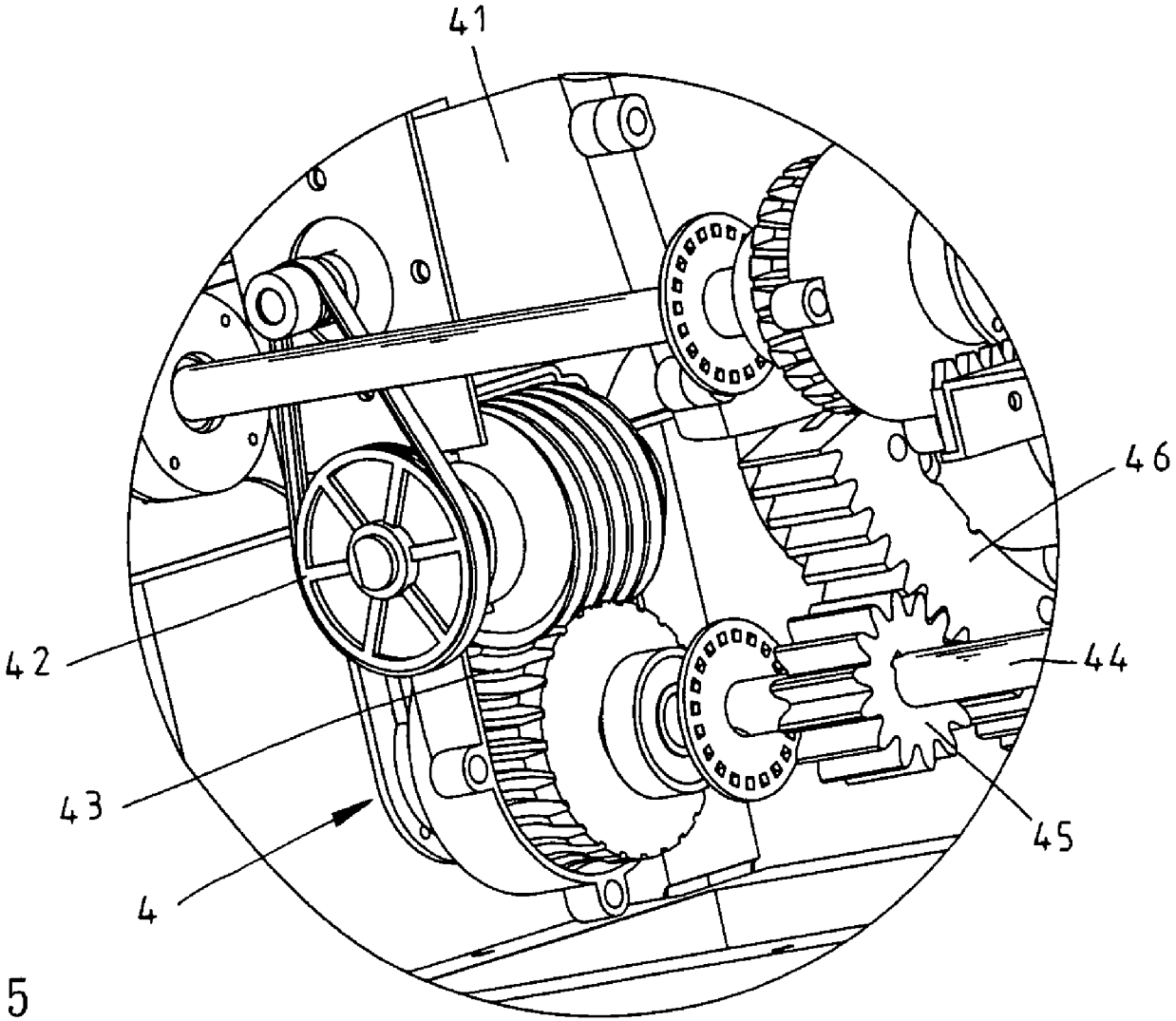
FIG. 5 PRIOR ART
FIG. 5 shows a partial schematic view of the prior art massaging machine.
Figure 6:
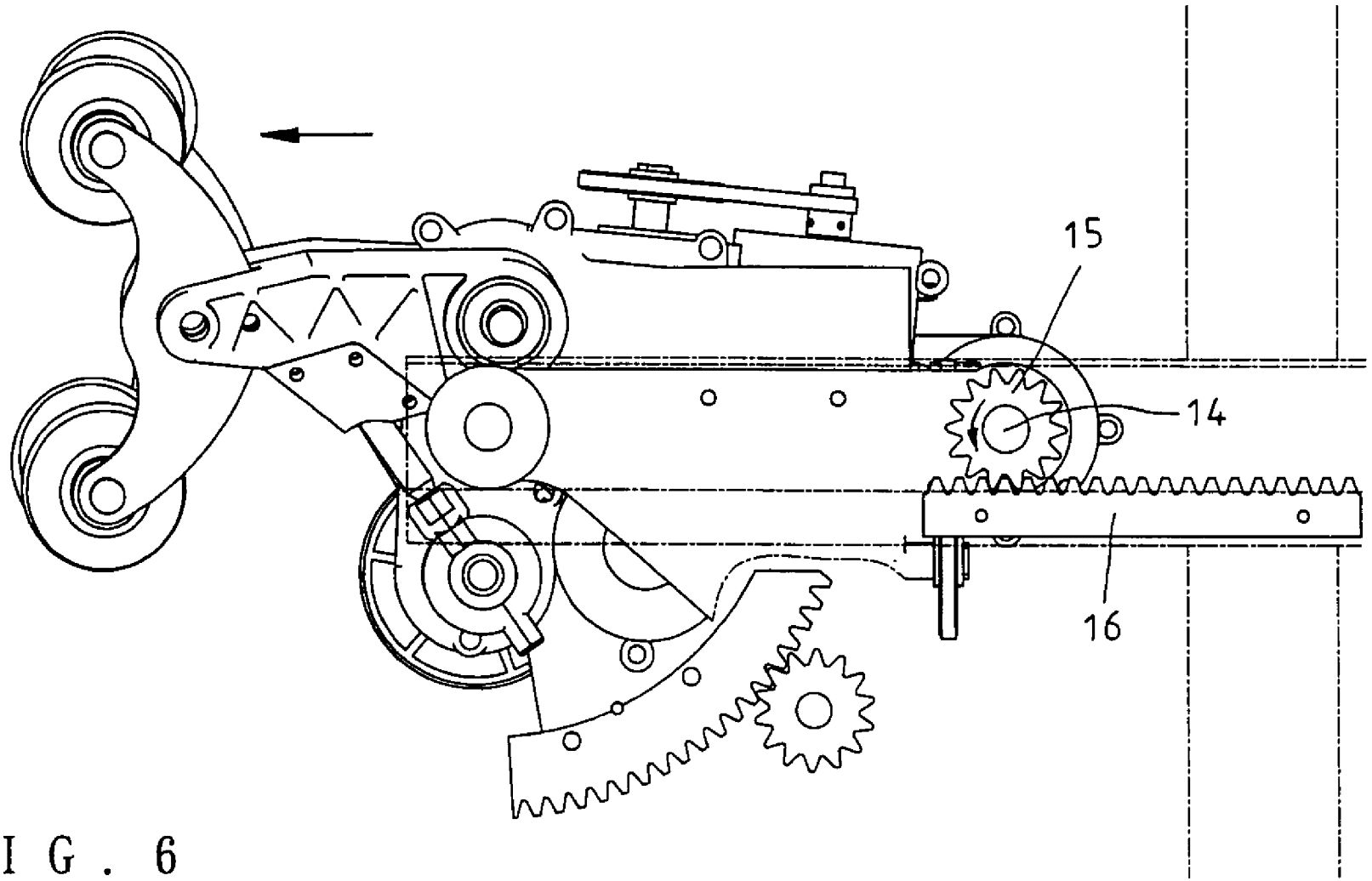
FIG. 6 PRIOR ART
FIG. 6 shows a schematic view of the displacement mechanism of the prior art massaging machine in use.
Figure 7:
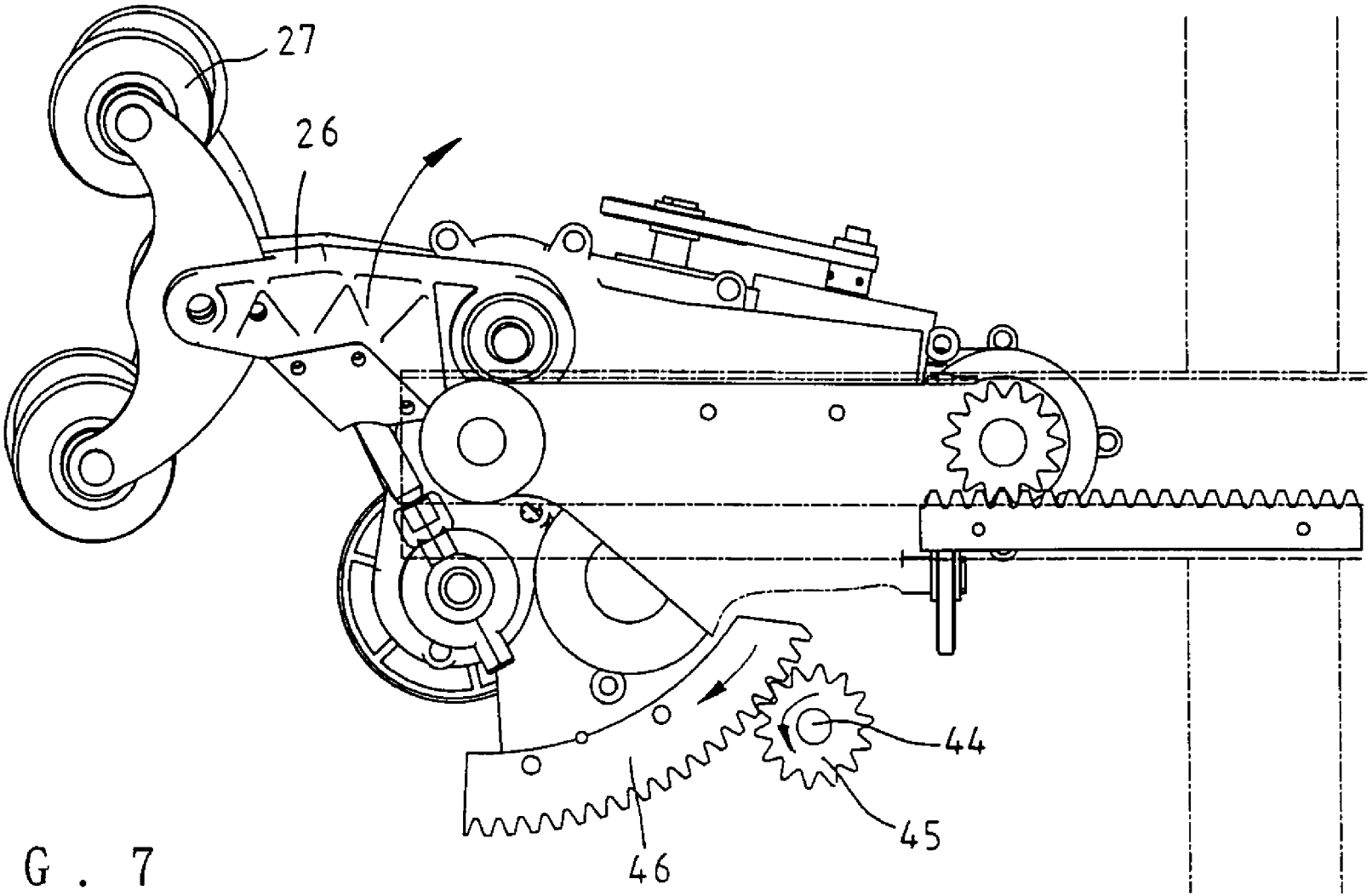
FIG. 7 PRIOR ART
FIG. 7 shows a schematic view of the adjustment mechanism of the prior art massaging machine in action.
Figure 8:
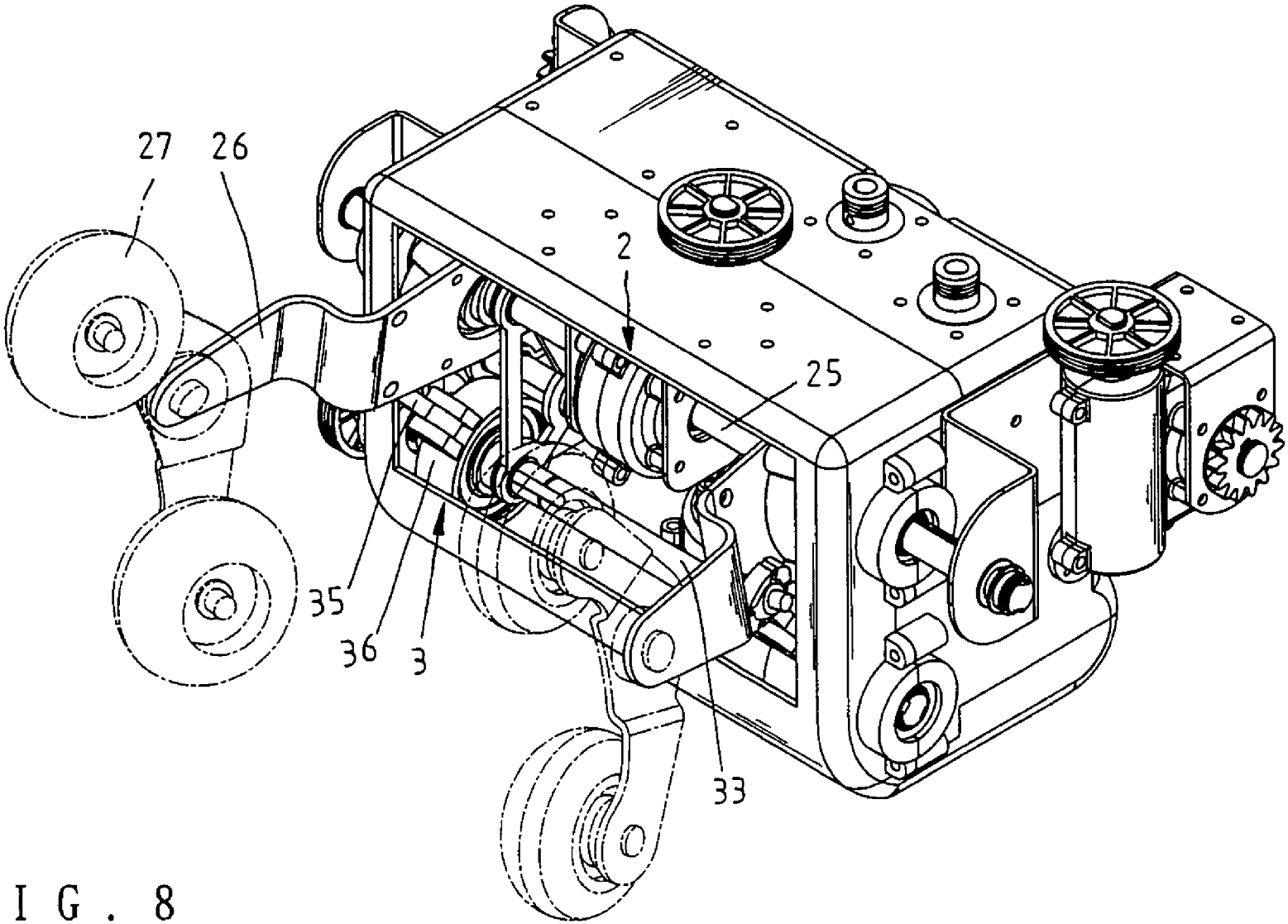
FIG. 8 shows a perspective view of a massaging machine of the preferred embodiment of the present invention.

As shown in FIGS. 1–8, a massaging machine embodied in the present invention comprises a frame displacement mechanism (not shown in the drawings), an angular adjustment mechanism (not shown in the drawings), a rubbing mechanism 2, a pounding mechanism 3, and a horizontal displacement mechanism 5.

The rubbing mechanism 2 comprises a rubbing shaft 25 which is provided with a guide slot 251 for accommodating a slide block 281 of a rubbing shaft sleeve 28 of an outwardly eccentric construction for fastening a swing arm 26 on which a massaging roller 27 is mounted.

The pounding mechanism 3 comprises a pounding shaft 33 which is provided with a guide slot 331 to accommodate a slide block 361 of a pounding shaft sleeve 36. The pounding shaft sleeve 36 is of an upwardly or downwardly eccentric construction and is provided with a connection rod 35 for connection a swing arm 26 of the massaging roller 27.

The horizontal mechanism 5 comprises a motor 51, and a drive member 52 mounted on a rotary shaft 511 of the motor 51. The drive member 52 is formed of two plates which are provided with a first connection rod 53 pivoted thereto. The first connection rods 53 are pivoted at one end with a longitudinally-oriented second connection rod 54, which is provided at one end with a connection portion 541 for connecting an auxiliary support shaft 55 and is fastened at other end with a horizontal link rod 56. The horizontal link rod 56 is provided at both ends with a triangular link plate 57 having two connection holes 571 and 572 which are fitted with the rubbing shaft 25 and the pounding shaft 33. The two link plates 57 are used to actuate the pounding shaft sleeve 36, the rubbing shaft sleeve 28, and the massaging rollers 27 to displace simultaneously.

Figure 10:
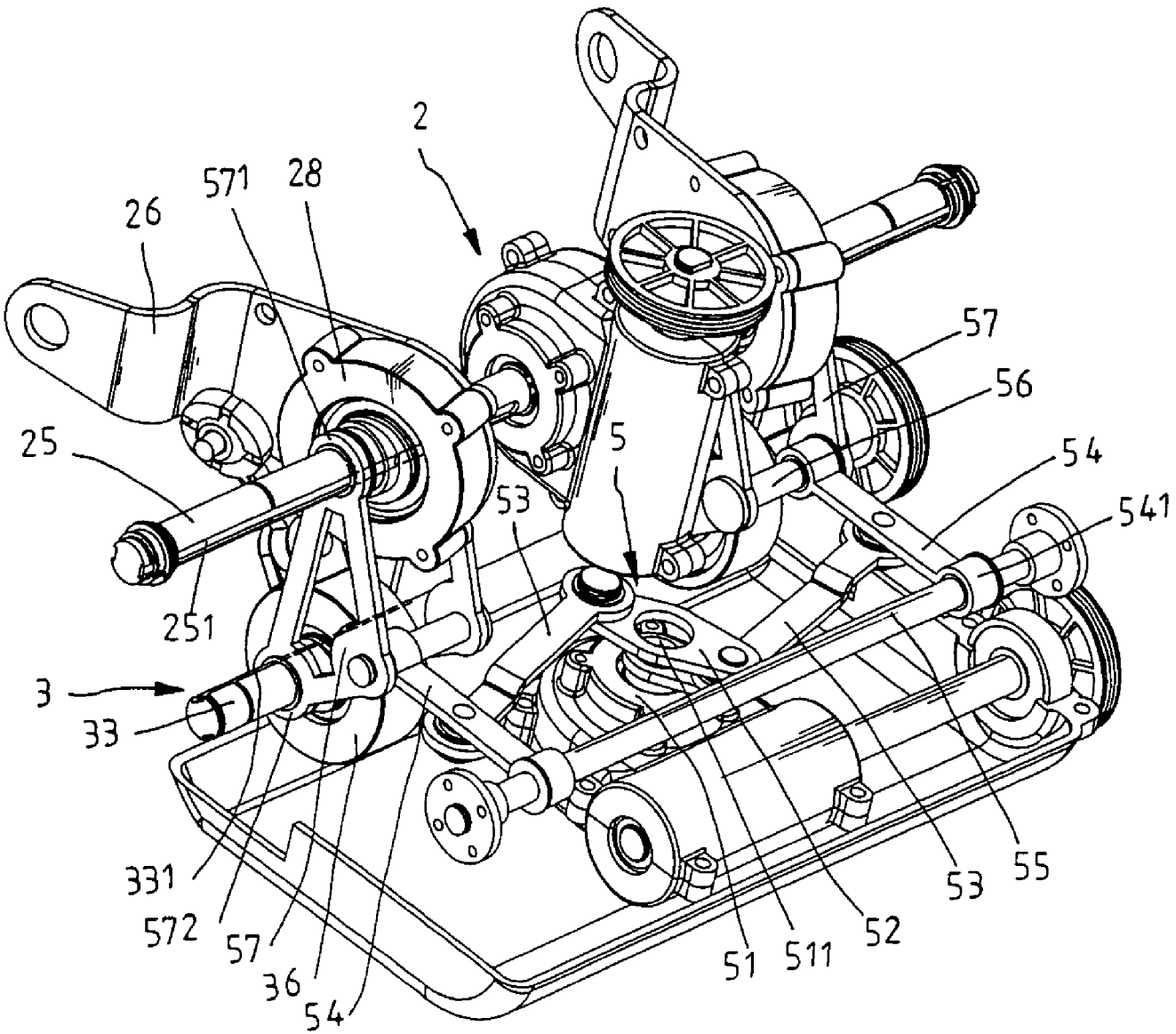
FIG. 10 shows another schematic view of the preferred embodiment of the present invention without the massaging rollers.
Figure 11:
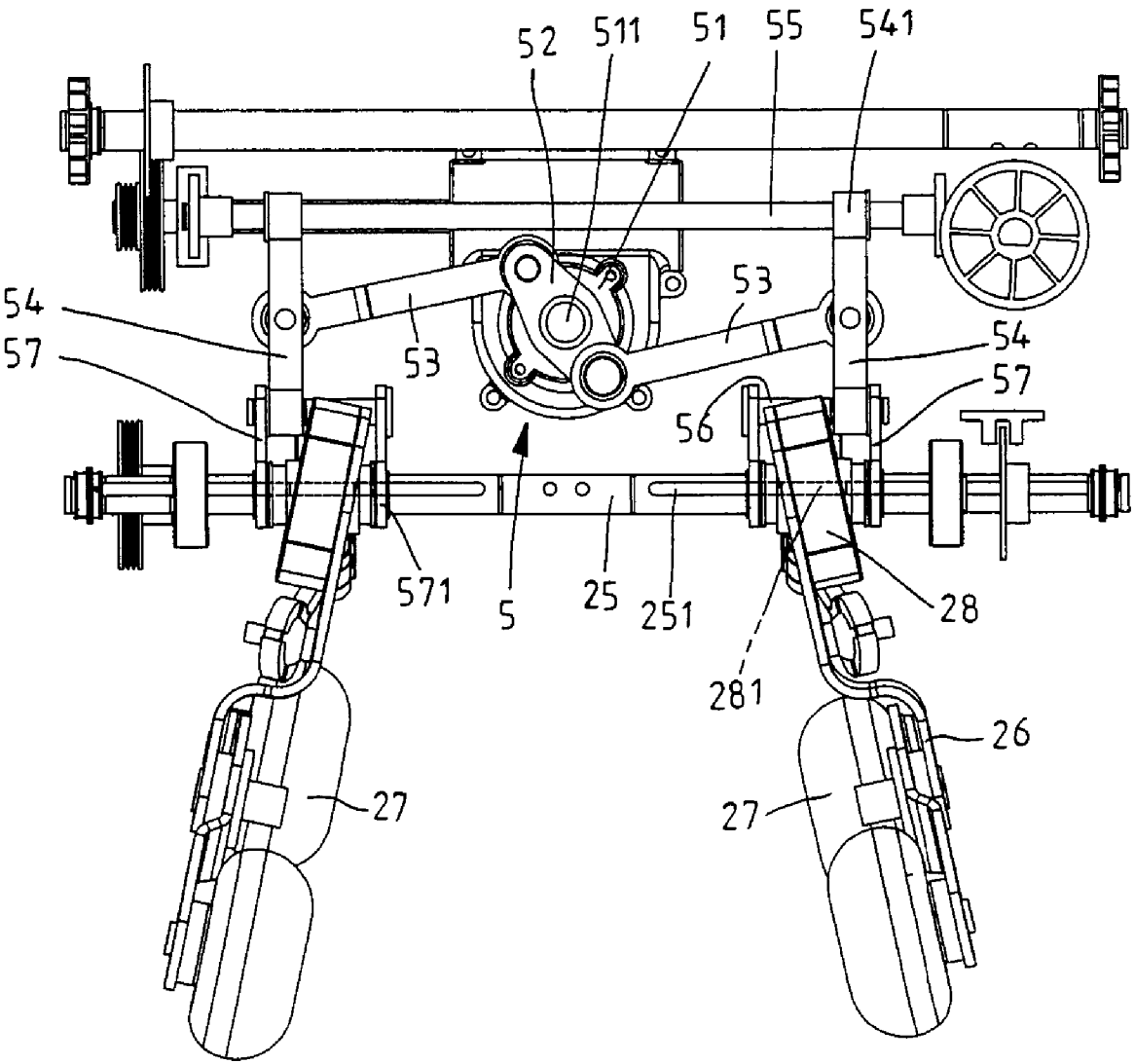
FIG. 11 shows a top view of a horizontal displacement mechanism of the preferred embodiment of the present invention.

As illustrated in FIGS. 10 and 11, when the rubbing shaft 25 is turned, the slide block 281 of the rubbing shaft sleeve 28 is urged longitudinally to actuate the rubbing shaft sleeve 28 to turn, thereby causing the massaging roller 27 to bring about a rubbing action.

Figure 9:
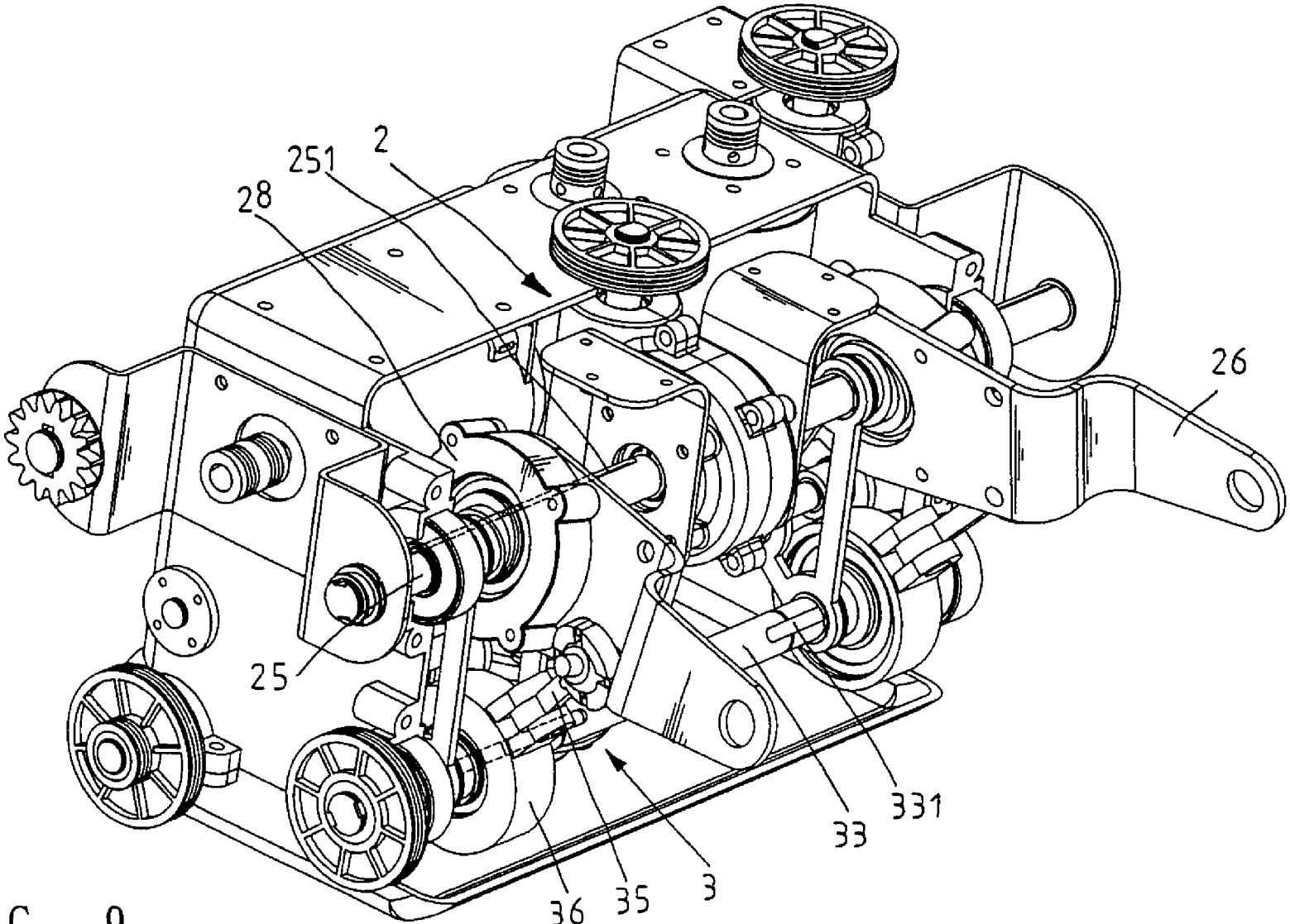
FIG. 9 shows a schematic view of the preferred embodiment of the present invention without the massaging rollers.
Figure 12:
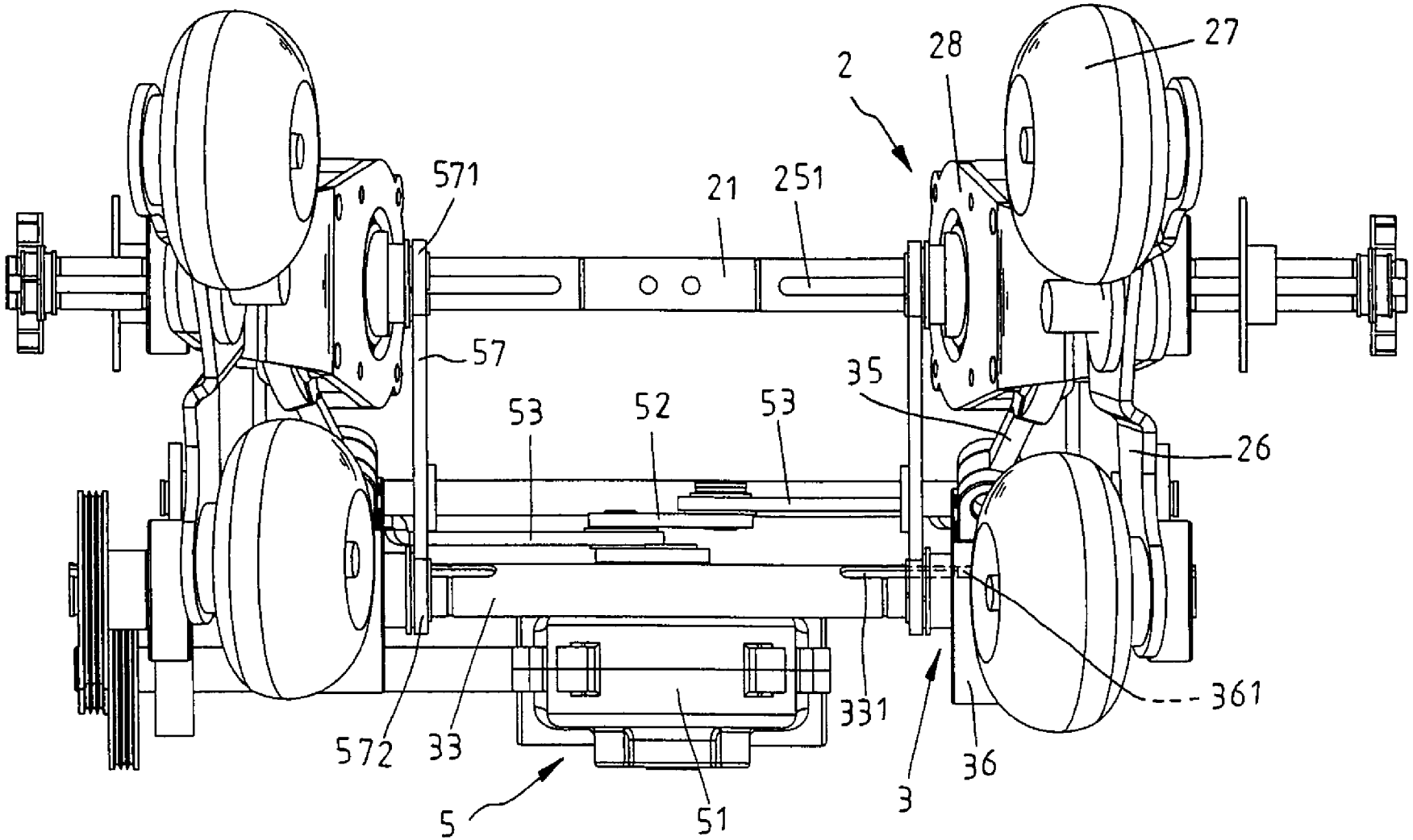
FIG. 12 shows a front view of the horizontal displacement mechanism of the preferred embodiment of the present invention.

As illustrated in FIGS. 9, 10 and 12, when the pounding 25 shaft 33 is turned, the slide block 361 of the pounding shaft sleeve 36 is urged to actuate the pounding shaft sleeve 36 to turn. As a result, the swing arm 26 is actuated by the connection rod 35 to swivel up and down, so as to enable the massaging roller 27 to bring about a pounding action.

Figure 13:
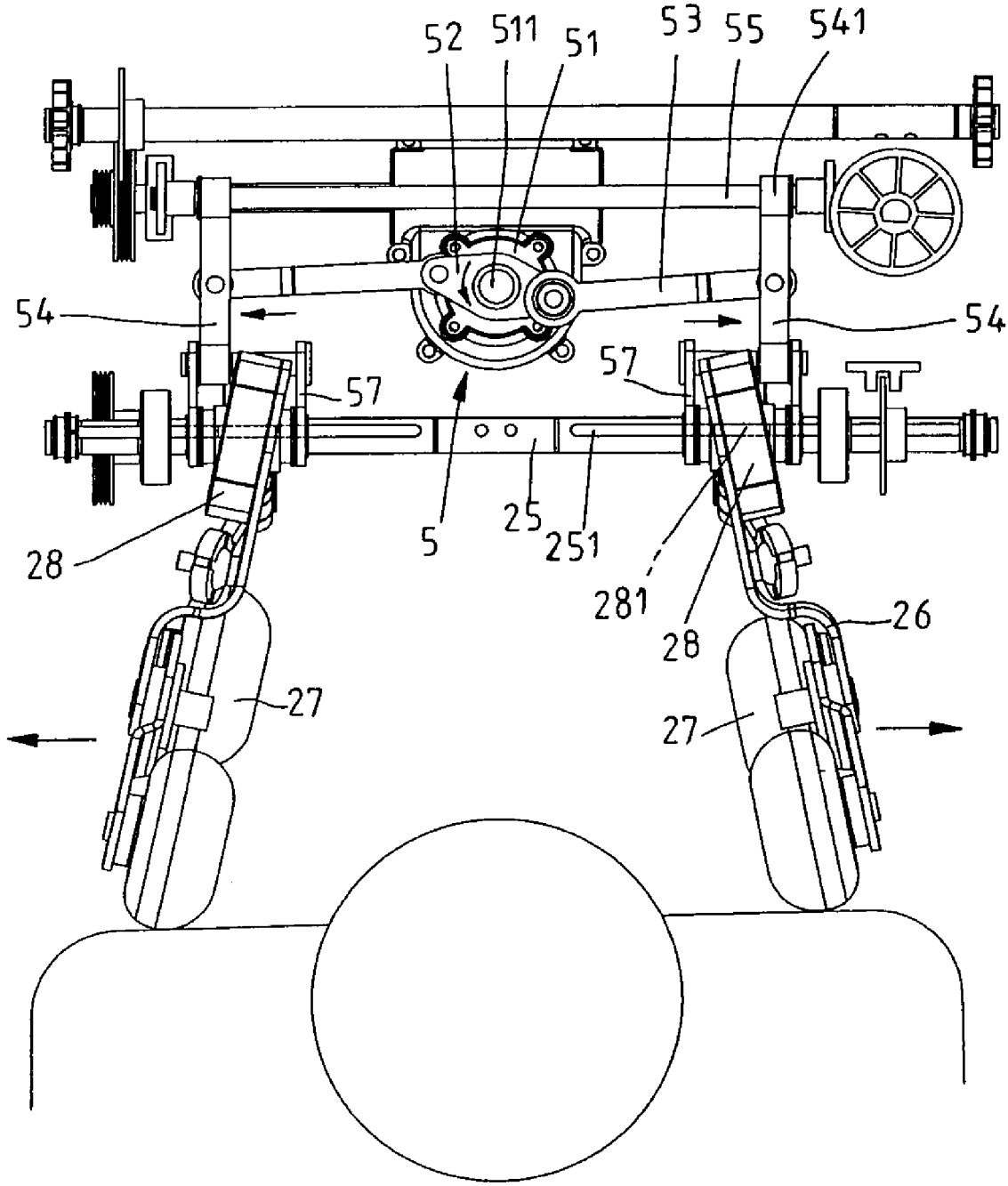
FIG. 13 shows a schematic view of the preferred embodiment of the present invention in action.

As illustrated in FIGS. 10, 12, and 13, the horizontal displacement mechanism 5 actuates the two massaging rollers 27 to displace outwardly such that the first connection rod 53 is actuated by the drive member 52 to engage in an outward displacement in verse direction, and that the second connection rod 54 is pushed by the first connection rod 54 to engage in an outward horizontal displacement. The link plates 57 of the second connection rod 54 push the rubbing shaft sleeve 28 and the pounding shaft sleeve 36, so as to cause the slide blocks 281 and 361 to slide respectively in the guide slots 251 and 331 of the rubbing shaft 25 and the pounding shaft 33. The second connection rod 54 is provided with the connection portion 541, which is caused to engage in a horizontal displacement on the auxiliary support shaft 55. As a result, the two massaging rollers 27 of the swing arms 26 of the rubbing shaft sleeve 28 are caused to displace horizontally and outwardly. The massaging areas of the massaging rollers 27 are thus expanded.

Figure 14:
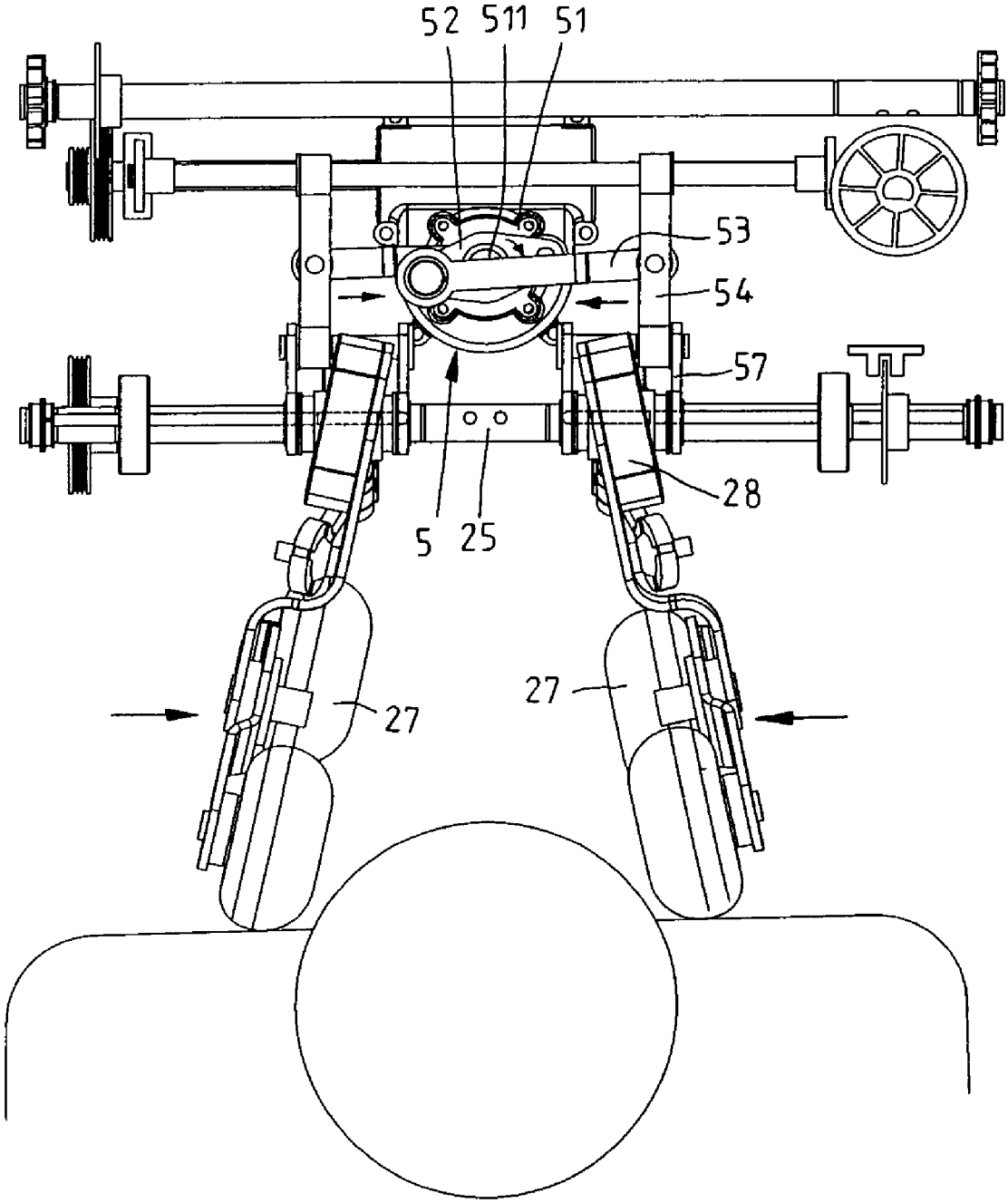
FIG. 14 shows another schematic view of the preferred embodiment of the present invention in action.

As shown in FIGS. 10, 12, and 14, the two massaging rollers 27 are actuated by the horizontal displacement mechanism 5 to engage in an inward displacement. As the motor 51 is started, the first connection rod 53 actuates the second connection rod 54 to engage in an inward horizontal displacement. In the meantime, the link plates 57 of the second connection rod 54 push the rubbing shaft sleeve 28 and the pounding shaft sleeve 36 to displace simultaneously in a horizontal and inward direction on the rubbing shaft 25 and the pounding shaft 33. As a result, the two massaging rollers 27 displace inwardly and horizontally, so as to cover different massaging areas.

The embodiment of the present invention described above is to be regarded in all respects as being illustrative and nonrestrictive. Accordingly, the present invention may be embodied in other specific forms without deviating from the spirit thereof. The present invention is therefore to be limited only by the scopes of the following claims.

What is claimed is:

1. A massaging machine comprising:

a plurality of massaging rollers;

a rubbing mechanism for actuating the massaging rollers to engage in a rubbing action;

a pounding mechanism for actuating the massaging rollers to engage in a pounding action; and a horizontal displacement mechanism for causing the massaging rollers to engage in a horizontal displacement on a rubbing shaft of the rubbing mechanism;

further wherein the rubbing shaft or the rubbing mechanism is provided with a rubbing shaft sleeve and a plurality of swing arms; the massaging rollers are mounted on the swing arms in conjunction with the rubbing shaft sleeve; the horizontal displacement mechanism comprises a drive source, a drive member driven by the drive source, a first connection rod pivoted with the drive member; and a second connection rod pivoted with the first connection rod whereby the second connection rod is fastened at one end between two sides of the rubbing shaft sleeve; and the rubbing shaft sleeve of the rubbing mechanism is of an eccentric construction and is provided therein with a slide block whereby the slide block is slidably located in a guide slot of the rubbing shaft.

2. The massaging machine as defined in claim 1, wherein the drive source is motor.

3. The massaging machine as defined in claim 1, wherein the second connection rod is provided at other end with a connection portion for connecting with an auxiliary support shaft.

4. A massaging machine comprising:

a plurality of massaging rollers;

a rubbing mechanism for actuating the massaging rollers to engage in a rubbing action;

a pounding mechanism for actuating the massaging rollers to engage in a pounding action; and a horizontal displacement mechanism for causing the massaging rollers to engage in a horizontal displacement on a rubbing shaft of the rubbing mechanism;

further wherein the rubbing shaft of the rubbing mechanism is provided with a rubbing shaft sleeve and a plurality of swing arms; the massaging rollers are mounted on the swing arms in conjunction with the rubbing shaft sleeve; the horizontal displacement mechanism comprises a drive source, a drive member driven by the drive source, a first connection rod pivoted with the drive member; and a second connection rod pivoted with the first connection rod whereby the second connection rod is fastened at one end between two sides of the rubbing shaft sleeve; and wherein the second connection rod of the horizontal displacement mechanism is fastened at one end with a horizontal rod of a link set, the horizontal rod being provided at two ends with a triangular link plate which is provided with a connection hole to fit with the rubbing shaft of the rubbing mechanism, thereby locating the two link plates at two sides of the rubbing shaft sleeve.

5. The massaging machine as defined in claim 4, wherein the link plates of the horizontal displacement mechanism are further provided with a connection hole to fit a pounding shaft of the pounding mechanism, thereby locating the two link plates at two sides of a pounding shaft sleeve.

6. The massaging machine as defined in claim 5, wherein the pounding shaft of the pounding mechanism is provided with a guide slot; wherein the pounding shaft sleeve is provided with a slide block whereby the slide block is slidably located in the guide slot of the pounding shaft.

* * * * *